US011154089B2

(12) United States Patent
Saygili

(10) Patent No.: US 11,154,089 B2
(45) Date of Patent: Oct. 26, 2021

(54) HOLDER FOR AEROSOL GENERATING ARTICLE

(71) Applicant: PHILIP MORRIS PRODUCTS S.A., Neuchatel (CH)

(72) Inventor: Ali Murat Saygili, Neuchatel (CH)

(73) Assignee: Philip Morris Products S.A., Neuchâtel (CH)

( * ) Notice: Subject to any disclaimer, the term of this patent is extended or adjusted under 35 U.S.C. 154(b) by 0 days.

(21) Appl. No.: 16/066,451

(22) PCT Filed: Dec. 6, 2016

(86) PCT No.: PCT/IB2016/057393
§ 371 (c)(1),
(2) Date: Jun. 27, 2018

(87) PCT Pub. No.: WO2017/115184
PCT Pub. Date: Jul. 6, 2017

(65) Prior Publication Data

US 2019/0014818 A1 Jan. 17, 2019

(30) Foreign Application Priority Data

Dec. 29, 2015 (EP) ..... 15202956

(51) Int. Cl.
*A24F 13/14* (2006.01)
*A24F 13/02* (2006.01)
(Continued)

(52) U.S. Cl.
CPC ..... *A24F 13/14* (2013.01); *A24D 1/22* (2020.01); *A24F 13/02* (2013.01)

(58) Field of Classification Search
CPC ..... A24F 13/14; A24F 13/16
See application file for complete search history.

(56) References Cited

U.S. PATENT DOCUMENTS 1,541,891 A 6/1925 Becker
1,941,531 A 1/1934 Blankenship
(Continued)

FOREIGN PATENT DOCUMENTS

GB 120185 10/1918
JP S63214173 A 9/1988
(Continued)

OTHER PUBLICATIONS

International Search Report and Written Opinion issued by the European Patent Office as the International Searching Authority, for PCT/IB2016/057393, dated Apr. 5, 2017; 15 pgs.
(Continued)

*Primary Examiner* — Michael H. Wilson
*Assistant Examiner* — Jennifer A Kessie
(74) *Attorney, Agent, or Firm* — Mueting Raasch Group

(57) ABSTRACT

A holder (200) for an aerosol generating article (100) includes a body (210) defining a passage extending from a first end to a second end of the body for receiving the aerosol generating article. The holder further includes a sleeve (220) having a (i) a ventilation region (222) including one or more holes, and (ii) an extinguishment region (224) downstream of the ventilation region. The sleeve is movable over the body between (i) a retracted position, (ii) an extinguishment position, and (iii) a use position between the retracted position and the extinguishment position. The ventilation region is configured to be aligned with the heat source (102) of the aerosol generating article when the sleeve is in the use position. The extinguishment region is configured to be aligned with the heat source of the aerosol generating article when the sleeve is in the extinguishment position.

20 Claims, 7 Drawing Sheets

(51) Int. Cl.

| | |
|---|---|
| ***A24D 3/04*** | (2006.01) |
| ***A24F 47/00*** | (2020.01) |
| ***A24D 1/22*** | (2020.01) |

(56) References Cited

U.S. PATENT DOCUMENTS

| | | | | |
|---|---|---|---|---|
| 2,008,433 | A | 7/1935 | Ashour | |
| 2,779,340 | A | 1/1957 | Mansfield | |
| 3,362,415 | A | 1/1968 | Ellis | |
| 3,796,223 | A * | 3/1974 | Tarrant | A24F 13/10 131/182 |
| 5,020,548 | A | 6/1991 | Farrier et al. | |
| 5,040,552 | A | 8/1991 | Schleich et al. | |
| 5,595,577 | A | 1/1997 | Bensalem et al. | |
| 2016/0324216 | A1* | 11/2016 | Li | A24F 47/008 |

FOREIGN PATENT DOCUMENTS

| | | | |
|---|---|---|---|
| JP | 591392 | | 12/1993 |
| WO | WO 98/54989 | A1 | 12/1998 |
| WO | WO 2009/022232 | A2 | 2/2009 |

OTHER PUBLICATIONS

Japanese Office Action for JP 2018-533923 issued by the Japanese Patent Office, dated Jan. 28, 2021; 4 pgs. including English Translation.

* cited by examiner

HOLDER FOR AEROSOL GENERATING ARTICLE

This application is the § 371 U.S. National Stage of International Application No. PCT/IB2016/057393, filed 6 Dec. 2016, which claims the benefit of European Application No. 15202956.7, filed 29 Dec. 2015.

This invention relates to an aerosol generating article having a combustible heat source for heating an aerosol generating substrate and a holder for the article.

A number of smoking articles in which tobacco is heated rather than combusted have been proposed in the art. An aim of such 'heated' smoking articles is to reduce certain smoke constituents of the type produced by the combustion and pyrolytic degradation of tobacco in conventional cigarettes.

In one known type of aerosol generating article, an aerosol is generated by the transfer of heat from a combustible heat source to a physically separate aerosol generating substrate, for example containing tobacco. The aerosol generating substrate may be located within, around or downstream of the combustible heat source. During use, volatile compounds are released from the aerosol generating substrate by heat transfer from the combustible heat source and entrained in air drawn through the smoking article. As the released compounds cool, they condense to form an aerosol that is inhaled by the user.

Heated smoking articles, and aerosol generating articles in general, may be configured so that the combustible heat source is blind, which may limit the amount or number volatile compounds released from combustion of the heat source that enter air drawn through the smoking article. Heated smoking articles having blind combustible heat sources may transfer heat to the aerosol-generating substrate primarily via conduction. Heated smoking articles may also be configured so that the heat source is non-blind. Heated smoking articles having non-blind combustible heat sources transfer heat to the aerosol-generating substrate primarily via convection through one or more air flow channels through the heat source, which allow volatile compounds from the heat source to enter air drawn through the smoking article. Because one aim of heated smoking articles is to reduce certain smoke constituents produced via combustion, heated smoking articles employing blind heat sources may be preferred.

Published PCT patent application, WO-A2-2009/022232, discloses an example of a heated smoking article having a non-blind heat source. The heated smoking article disclosed in WO-A2-2009/022232 comprises a combustible heat source, an aerosol generating substrate downstream of the combustible heat source, and a heat conducting element around and in contact with a rear portion of the combustible heat source and an adjacent front portion of the aerosol generating substrate. An air flow channel extends through the heat source such that air may be drawn through the channel downstream towards a mouthpiece.

Regardless of whether heated smoking articles include a blind or non-blind combustible heat source, the heat source may require direct contact with air to burn properly. Thus, heated smoking articles may be manufactured such that the heat source is exposed to a smoker and their surroundings during smoking. However, temperatures of the combustible heat sources may be quite high when burning. For example, temperatures of the heat sources during combustion may be more than 600° C.

One advantage of at least some examples of the invention is to reduce the temperature of an exposed element to which a user of an aerosol generating article having a combustible heat source or their environment may be exposed. Another advantage of at least some examples of the invention is to facilitate extinguishment of a combustible heat source of an aerosol generating article. Another advantage of at least some examples of the invention is to maintain a blind heat source while reducing the temperature of an exposed element to which a user or their environment may be exposed.

In various aspects, the invention provides holder for an aerosol generating article. The holder comprises a body having a first end and a second end and passage extending from the first end to the second end. The body is configured to receive the aerosol generating article into the passage. The holder further comprises a sleeve having a tubular body defining a first end and a second end. The tubular body comprises (i) a ventilation region comprising one or more holes through the tubular body in proximity to the second end, and (ii) an extinguishment region adjacent the ventilation region. The extinguishment region is between the first end and the ventilation region. The sleeve is moveable, for example slidable, over the body between (i) a retracted position, (ii) an extinguishment position, and (iii) a use position between the retracted position and the extinguishment position. The second end of the sleeve is closer to the first end of the body when the sleeve is in the retracted position relative to when the sleeve is in the extinguishment position. The ventilation region is configured to be aligned with the heat source of the aerosol generating article when the sleeve is in the use position. The extinguishment region is configured to be aligned with the heat source of the aerosol generating article when the sleeve is in the extinguishment position.

The term "aerosol generating article" refers to an article comprising an aerosol generating substrate that releases volatile compounds to form an aerosol that may be inhaled by a user. The term "aerosol-generating substrate" refers to a substrate capable of releasing, upon heating, volatile compounds, which may form an aerosol. The aerosols generated from aerosol-generating substrates of articles according to the invention may be visible or invisible and may include vapours (for example, fine particles of substances, which are in a gaseous state, that are ordinarily liquid or solid at room temperature) as well as gases and liquid droplets of condensed vapours.

The terms "distal," "upstream," "proximal," and "downstream" are used to describe the relative positions of components, or portions of components, of an aerosol generating article. Aerosol generating articles according to the invention have a proximal end through which, in use, an aerosol exits the article for delivery to a user, and have an opposing distal end. The proximal end of the aerosol generating article may also be referred to as the mouth end. In use, a user draws on the proximal end of the aerosol generating article in order to inhale an aerosol generated by the aerosol generating article. The terms upstream and downstream are relative to the direction of aerosol movement through the aerosol generating article when a user draws on the proximal end.

Various aspects of the aerosol generating articles and holders according to the present invention may have one or more advantages relative to currently available aerosol generating articles that include a combustible heat source. For example, holders according to the invention provide a simple to use barrier to protect a smoker or their surrounding environment from contact with a combusted heat source having a high temperature. When the sleeve is in the use position, the ventilation region surrounds the heat source and is separated from the heat source so that the temperature of the ventilation region is lower than the temperature of the combusted heat source. The ventilation region and sleeve can also be configured to efficiently dissipate heat to reduce temperature of the ventilation region relative to the combusted heat source. By way of further example, a holder of the invention can facilitate extinguishment by an easy to use, simple mechanical mechanism. Simply sliding the sleeve from the use position to the extinguishment position may result in extinguishment of the heat source. In some preferred embodiments, holders according to the invention are configured to prevent or reduce the number or amount volatile compounds released from the heat source during combustion from entering air drawn through the aerosol generating article and inhaled by a user. For example, a holder may include a seal extending from an inner surface of the sleeve. The seal may be arranged to surround and seal the aerosol generating article between the heat source and, for example, the aerosol-generating substrate to limit volatile compounds released from the heat source during combustion from entering drawn through the aerosol generating article. Additional advantages of one or more aspects of aerosol generating articles described herein will be evident to those of skill in the art upon reading and understanding the present disclosure.

The present invention relates to an aerosol generating article having a combustible heat source for heating an aerosol generating substrate and a holder for the aerosol generating article. The holder includes a sleeve comprising a ventilation region that surrounds the heat source and is separated from the heat source so that the temperature of the ventilation region is lower than the temperature of the combusted heat source. The ventilation region and sleeve can also be configured to efficiently dissipate heat to reduce temperature of the ventilation region relative to the combusted heat source. In use, the temperature of the ventilation region and sleeve is substantially lower than the heat source during combustion. Accordingly, the temperature of an element to which a user of the aerosol generating article may be exposed is reduced. The sleeve also comprises an extinguishment region that can be slid over the heat source to extinguish the heat source when a user has finished using the aerosol generating article.

A holder according to the present invention comprises a body having a first end and a second end. The body defines a passage from the first end to the second end for receiving an aerosol generating article having a combustible heat source. The body may be configured to receive, for example slidably receive, the aerosol generating article into the passage through the second end. In addition or alternatively, the body may define a window or recess for lateral insertion of the aerosol generating article. The passage defines an inner surface of the body. Preferably, at least a portion of the inner surface of the mouthpiece engages the aerosol generating article when the article is received in the passage. For example, the inner surface of the body may define one or more detents or one or more reduced inner diameter portions that are configured to engage the aerosol generating article by interference fit. In addition or alternatively, the passage may be sized to engage the aerosol generating article along its length.

Alternatively, one or more additional elements disposed in the passage may engage the aerosol generating article. Regardless of whether the inner surface of the body is configured to engage the aerosol generating article or whether an additional element in the passage is configured to engage the aerosol generating article, the aerosol generating article is preferably retained in a longitudinal position relative to the body in use. The aerosol generating article is preferably insertable or removable from the passage with minimal force. For example, the aerosol generating article may be readily inserted or withdrawn from the passage by a user.

The body may be formed of any suitable material or combination of materials. For example, the body may be formed from a material comprising a polymer, such as a thermoplastic polymer, or a material comprising a metal, such as aluminium. Preferably, the body comprises a semi-crystalline polymer. Examples of suitable polymers from which the body or a portion of the body may be made include polyethter ether ketone (PEEK), polyoxymethylene (POM), high density polyethylene (HDPE) and the like.

An exterior surface of the body may define one or more longitudinal channels in which detents of an inner surface of the sleeve can slide. The exterior surface of the body may further define slots that extend away from, and which are contiguous with, the channels. A slot may serve to retain the sleeve in a predetermined position. For example, a slot may interact with a detent of an inner surface of the sleeve to retain the sleeve in a retracted position, a use position, or an extinguishment position.

The sleeve comprises a ventilation region at one end. The ventilation region may define a bore having a longitudinal axis and an inner diameter greater than the outer diameter of the heat source of the aerosol generating article. As used herein, the term 'diameter' denotes the maximum dimension in the transverse direction of the combustible heat source, aerosol generating article, holder or other apparatus or component. As used herein, the terms 'radial' and 'transverse' are used to describe the direction perpendicular to the longitudinal direction. In use, the ventilation region at least partially surrounds the heat source. Preferably, the ventilation region surrounds the heat source along the length of the heat source. The distance between the ventilation region and the heat source, the material of the ventilation region, the thickness of the ventilation region, and the permeability of the ventilation region, among other factors, may be selected to control the maximum temperature, relative to the heat source when in use. Preferably, the ventilation region reaches a maximum temperature substantially lower than the heat source when the heat source is combusted and is disposed within the ventilation region. For example, a temperature at an exposed surface of the ventilation region may be at least 200° C. less than the temperature of a surface of the heat source. Preferably, a temperature at an exposed surface of the ventilation region may be at least 300° C. less than the temperature of a surface of the heat source. For example, when the heat source temperature is about 400° C., preferably the exposed surface of the retainer is less than about 200° C., preferably less than about 150° C.

The ventilation region may be separated from the heat source by any suitable distance. For example, the radial clearance between the heat source and the ventilation region may be between about 0.2 mm and about 3 mm. Preferably, the radial clearance between the heat source and the ventilation region is between about 0.5 mm and about 1 mm. For example, the radial clearance between the ventilation region and the heat source may be about 0.5 mm or less.

The ventilation region has sufficient permeability to allow air to access the heat source through the ventilation region to maintain combustion of the heat source. The term "permeability" refers to a percent of total area of a surface or a portion of a surface that is void space area. Preferably at least a portion of the ventilation region that surrounds the heat source has sufficient permeability to allow a lighting of the heat source by a flame. The ventilation region comprises openings, such as through-holes, disposed radially about the heat source. In preferred embodiments, the ventilation region comprises a generally tubular wall with ventilation openings through the wall.

The sleeve may comprise one or more through holes downstream of the ventilation region and thus downstream of the heat source when the aerosol generating article is received in the passage of the body. The through holes may be arranged to allow air flow into the aerosol generating article. Where air inlets are present in the aerosol generating article, the through holes of the sleeve may be arranged to allow air external to the sleeve to be drawn through the holes, through the air inlets of the aerosol generating article and into a mouth of a user. The through holes may enhance air flow over the aerosol generating substrate to increase release of volatile compounds from the substrate, to increase delivery of volatile compounds to a user, or increase release of volatile compounds from the substrate and increase delivery of volatile compounds to a user.

The apparatus may further comprise a seal or baffle extending from an inner surface of the sleeve. The seal or baffle may be configured and arranged to contact the aerosol generating article downstream of the heat source. The holes through the sleeve, if present, may be downstream of the seal or baffle. The seal or baffle can limit the amount or number of combustion products from the heat source from entering air drawn through the aerosol generating article and delivered to a user. Preferably, the apparatus further comprises a seal.

The seal may have any suitable inner diameter. Preferably, the inner diameter of the seal, in a relaxed state, is less than the outer diameter of the aerosol generating article. The seal may deflect to allow insertion of the aerosol generating article through the seal. The seal may aid in holding the sleeve in a longitudinal position relative to the aerosol generating article.

The seal may be integrally formed with the sleeve or attached to the sleeve in any suitable manner. The seal may be formed of any suitable material or combination of materials. Because the seal is configured to be placed in proximity to the heat source, the seal preferably comprises heat resistant materials. The seal preferably comprises a resilient material. The seal may comprise an o-ring. A seal may be provided at the head of a plunger. Inlets may be provided in the holder downstream of the seal. Examples of materials that may be used to form a seal or a portion thereof include plastic materials and elastomers, for example nitrile or fluorocarbons (viton) materials.

The sleeve further comprises an extinguishment region downstream of the ventilation region. The extinguishment region is configured to surround at least a portion of the heat source in the extinguishment position and restrict air flow to heat source to facilitate extinguishment. The extinguishment region may be formed of any suitable material and be of any suitable structure to have a sufficiently low permeability to extinguish the heat source. In some preferred embodiments, the extinguishment region comprises a polymeric or metallic solid walled portion.

The extinguishment region may be separated from the heat source by any suitable distance. For example, the radial clearance between the heat source and the extinguishment region may be between about 0.2 mm and about 3 mm. For example, the radial clearance between the extinguishment region and the heat source may be about 0.5 mm or less. Preferably, the radial clearance between the heat source and the extinguishment region is between about 0.5 mm and about 2 mm, for example between about 1 mm and about 2 mm.

The sleeve may be formed from one or more parts. Preferably, the sleeve is formed from one part. The sleeve may be formed from one or more suitable materials. Preferably, the sleeve comprises a polymeric material. More preferably, the sleeve comprises a semi-crystalline polymeric material. Examples of suitable polymeric materials of which the sleeve or portions of the sleeve can be made include polyether ether ketone (PEEK), polyoxymethylene (POM) and high density polyethylene (HDPE). The sleeve may comprise metallic materials. For example, the sleeve may comprise aluminium or stainless steel.

As described above, the sleeve may have an inner surface defining one or more detents configured to slide in channels defined by an exterior surface of the body or slots contiguous with the channels. The sleeve can be at least partially rotatable about the body such that rotation of the sleeve when the detent is aligned with an intersection of a slot and the channel causes the detent to slide within the slot. The sleeve can be locked into the retracted position, the extinguishment position, or the use position depending when an appropriate detent is received in an appropriate slot. The sleeve or portions of the sleeve may be transparent to allow the interaction of the detents of the inner surface of the sleeve and the channels or slots of the exterior surface of the body.

Preferably, the sleeve is biased towards the extinguishment position, for example via a spring. The sleeve may be manually withdrawn and locked into the use position or the retracted position, for example through interactions of detents with slots as described above.

A holder according to the present invention may include a mouthpiece. The body may extend to form the mouthpiece or the mouthpiece may be connected to the body. The mouthpiece has a mouth end and a distal end. The mouthpiece defines a passage between the mouth end and the distal end for flow of aerosol from the aerosol generating article.

The mouthpiece may be telescoping and may adapt a collapsed, ejection position and an expanded, use position. Preferably, the mouth end is movable distally relative to the distal end to the collapsed position to eject the aerosol generating article from the holder. The mouth end may be biased, for example via a spring, towards the expanded position so the mouth end moves distally relative to the distal end after a pushing force, for example to collapse the mouthpiece, is removed. A tube may be disposed in the mouthpiece and extend into the passage of the body. As the mouth end of the telescoping mouthpiece is pressed and moved distally, the tube can press against the aerosol generating article and cause the article to move distally.

A holder according to the present invention may be configured to allow an aerosol generating article to be inserted into a passage the body when the sleeve is in a retracted position. Once the aerosol generating article is inserted into the passage of the body, the sleeve may be slid over the body to the use position such that the ventilation region of the sleeve is disposed about the heat source of the aerosol generating article. The heat source may be ignited by, for example, a flame. A user may draw on the mouth end of the aerosol generating article or the mouthpiece of the holder, if present, to inhale aerosol from the aerosol generating article. When the user has completed a use of the article, the sleeve may be moved to the extinguishment position such that the extinguishment region surrounds the heat source.

If the holder comprises a telescoping mouthpiece, the mouth end of the mouth piece may be pressed and moved distally relative to the body to eject the aerosol generating article from the holder once the heat source has been extinguished.

Holders according to the present invention may be used with any suitable aerosol generating article having a combustible heat source. The aerosol generating article includes an aerosol generating substrate that may be heated by the combustible heat source to release one or more volatile compounds from the aerosol generating substrate.

An aerosol generating article for use with an end piece according to the present invention may include any suitable combustible heat source.

The combustible heat source is preferably a blind combustible heat source. As used herein, the term 'blind' describes a heat source that does not comprise any air flow channels that provide inhalation air to the aerosol generating substrate. In a blind combustible heat source, heat transfer from the blind combustible heat source to the aerosol-generating substrate occurs primarily by conduction and heating of the aerosol generating substrate by forced convection is minimized or reduced. The lack of any airflow channels through the blind combustible heat source advantageously substantially prevents or inhibits activation of combustion of the blind combustible heat source during puffing by a user. This substantially prevents or inhibits spikes in the temperature of the aerosol generating substrate during puffing by a user. By preventing or inhibiting activation of combustion of the blind combustible heat source, and so preventing or inhibiting excess temperature increases in the aerosol generating substrate, combustion or pyrolysis of the aerosol generating substrate under intense puffing regimes may be advantageously avoided. In addition, the impact of a user's puffing regime on the composition of the mainstream aerosol may be advantageously minimized or reduced. The inclusion of a blind combustible heat source may also advantageously substantially prevent or inhibit combustion and decomposition products and other materials formed during ignition and combustion of the blind combustible heat source from entering air drawn through the aerosol generating article during use thereof.

Alternatively, the combustible heat source comprises at least one longitudinal airflow channel, which provides one or more inhalation airflow pathways through the heat source to the aerosol generating substrate. This inhalation airflow channel may extend along the length of the heat source through which air may be drawn through the aerosol generating article for inhalation by a user. Such heat sources including one or more longitudinal inhalation airflow channels are referred to herein as "non-blind" heat sources.

The combustible heat source is preferably a carbonaceous heat source having a carbon content of at least about 35 percent, more preferably of at least about 40 percent, most preferably of at least about 45 percent by dry weight of the combustible heat source. Where the combustible heat source is a carbonaceous heat source, the combustible heat source may be formed from one or more suitable carbon-containing materials. The term "carbonaceous" refers to a material that comprises carbon.

The combustible heat source may be a combustible carbon-based heat source having a carbon content of at least about 50 percent. For example, the combustible heat source may be a combustible carbon-based heat source having a carbon content of at least about 60 percent, or at least about 70 percent, or at least about 80 percent by dry weight of the combustible heat source. The term "carbon-based" refers to a material comprises primarily of carbon or at least about 50% carbon, by dry weight of material.

One or more binders may be combined with the one or more carbon-containing materials to form the carbonaceous heat source. The combustible heat source may comprise one or more organic binders, one or more inorganic binders or a combination of one or more organic binders and one or more inorganic binders.

Instead of, or in addition to one or more binders, the combustible heat source may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$). Combustible heat sources for aerosol generating articles and methods for producing such heat sources are known in the art and described in, for example, U.S. Pat. Nos. 5,040,552 and 5,595,577.

Preferably, the combustible heat source has an apparent density of between about 0.8 g/cm$^3$ and about 1.1 g/cm$^3$. Preferably, the combustible heat source has a mass of between about 300 mg and about 500 mg, more preferably of between about 400 mg and about 450 mg. Preferably, the combustible heat source has a length of between about 7 mm and about 17 mm, more preferably of between about 7 mm and about 15 mm, most preferably of between about 7 mm and about 13 mm. Preferably, combustible heat sources according to the invention have a diameter of between about 5 mm and about 9 mm, more preferably of between about 7 mm and about 8 mm.

Preferably, the combustible heat source is of substantially uniform diameter. However, the combustible heat source may alternatively be tapered such that the diameter of one of the front end face and the rear end face of the combustible heat source is greater than the diameter of the other of the front end face and the rear end face thereof. For example, combustible heat sources may be tapered such that the diameter of the rear end face of the combustible heat source is greater that the diameter of the front end face of the combustible heat source. Preferably, the combustible heat source is substantially cylindrical. The combustible heat source may be a cylindrical combustible heat source of substantially circular cross-section or of substantially elliptical cross-section. In particularly preferred embodiments, the combustible heat source is a substantially cylindrical combustible heat source of substantially circular cross-section.

An aerosol generating article for use with a holder according to the invention may include any aerosol generating substrate.

Preferably, the aerosol generating substrate comprises at least one aerosol-former and a material capable of releasing volatile compounds in response to heating. The aerosol generating substrate may comprise other additives and ingredients including, but not limited to, humectants, flavorants, binders and mixtures thereof. Preferably, the aerosol generating substrate comprises nicotine. More preferably, the aerosol generating substrate comprises tobacco.

The at least one aerosol-former may be any suitable known compound or mixture of compounds that, in use, facilitates formation of a dense and stable aerosol and that is substantially resistant to thermal degradation at the operating temperature of the aerosol generating article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in aerosol generating articles herein are polyhydric alcohols or mixtures thereof, such as triethylene glycol, 1,3-butanediol and, most preferred, glycerin.

The material capable of emitting volatile compounds in response to heating may be a charge of plant-based material. The material capable of emitting volatile compounds in response to heating may be a charge of homogenized plant-based material. For example, the aerosol generating substrate may comprise one or more materials derived from plants including, but not limited to: tobacco; tea, for example green tea; peppermint; laurel; eucalyptus; basil; sage; verbena; and tarragon. Preferably, the material capable of emitting volatile compounds in response to heating is a charge of tobacco-based material, most preferably a charge of homogenised tobacco-based material.

The aerosol generating substrate may be in the form of a plug or segment comprising a material capable of emitting volatile compounds in response to heating circumscribed by a paper or other wrapper. As stated above, where an aerosol generating substrate is in the form of such a plug or segment, the entire plug or segment including any wrapper is considered to be the aerosol generating substrate. The aerosol generating substrate preferably has a length of between about 5 mm and about 20 mm. Preferably, the aerosol generating substrate has a length of between about 6 mm and about 15 mm or a length of between about 7 mm and about 12 mm. In preferred embodiments, the aerosol generating substrate comprises a plug of tobacco-based material wrapped in a plug wrap. In particularly preferred embodiments, the aerosol generating substrate comprises a plug of homogenised tobacco-based material wrapped in a plug wrap.

Holders according to the present invention may be used with any suitable aerosol generating article.

Aerosol generating articles for use with holders according to the present invention may comprise one or more air inlets around the periphery of the aerosol generating substrate. In such embodiments, in use, cool air is drawn into the aerosol generating substrate of the aerosol generating article through the air inlets. The air drawn into the aerosol generating substrate through the air inlets passes downstream through the aerosol generating article from the aerosol generating substrate and exits the aerosol generating article through the mouthpiece or proximal end thereof.

In such embodiments, during puffing by a user the cool air drawn through the one or more air inlets around the periphery of the aerosol generating substrate advantageously reduces the temperature of the aerosol generating substrate. This advantageously substantially prevents or inhibits spikes in the temperature of the aerosol generating substrate during puffing by a user. As used herein, the term 'cool air' is used to describe ambient air that is not significantly heated by the combustible heat source upon puffing by a user.

Aerosol generating articles described herein may comprise a heat conducting element around and in direct contact with both at least a rear portion of the heat source and at least a front portion of the aerosol generating substrate. The heat conducting element provides a thermal link between the combustible heat source and the aerosol generating substrate and advantageously helps to facilitate adequate heat transfer from the combustible heat source to the aerosol generating substrate to provide an acceptable aerosol.

Suitable heat conducting elements for use herein include, but are not limited to: metal foil wrappers such as, for example, aluminum foil wrappers, steel wrappers, iron foil wrappers and copper foil wrappers; and metal alloy foil wrappers.

Aerosol generating articles described herein may comprise a mouthpiece located at the proximal end thereof. Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavorants, and other aerosol modifiers and additives or combinations thereof.

Aerosol generating articles described herein preferably further comprise a transfer element or spacer element between the aerosol generating substrate and the mouthpiece. The transfer element may abut one or both of the aerosol generating substrate and the mouthpiece. Alternatively, the transfer element may be spaced apart from one or both of the aerosol generating substrate and the mouthpiece.

The inclusion of a transfer element advantageously allows cooling of the aerosol generated by heat transfer from the combustible heat source to the aerosol-generating substrate. The inclusion of a transfer element also advantageously allows the overall length of the aerosol generating article to be adjusted to a desired value, for example to a length similar to that of a conventional cigarette, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the aerosol generating article, and the presence and length of other components within the aerosol generating article.

Preferably, the transfer element comprises at least one open-ended tubular hollow body. In such embodiments, in use, air drawn into the aerosol generating article passes through the at least one open-ended tubular hollow body as it passes downstream through the aerosol generating article from the aerosol generating substrate to the mouthpiece. The transfer element may comprise at least one open-ended tubular hollow body formed from one or more suitable materials that are substantially thermally stable at the temperature of the aerosol generated by the transfer of heat from the combustible heat source to the aerosol generating substrate. Suitable materials are known in the art and include, but are not limited to, paper, cardboard, plastics, such a cellulose acetate, ceramics and combinations thereof.

Alternatively or in addition, aerosol generating articles described herein may comprise an aerosol cooling element or heat exchanger between the aerosol generating substrate and the mouthpiece. The aerosol cooling element may comprise a plurality of longitudinally extending channels. The aerosol cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminum foil. Preferably the aerosol-cooling element may comprise a gathered sheet of biodegradable polymeric material, such as polylactic acid (PLA) or a grade of Mater-Bi® (a commercially available family of starch based copolyesters).

The aerosol generating articles described herein may comprise an outer wrapper that circumscribes the aerosol generating substrate and at least a rear portion of the heat source or heat source holder. The outer wrapper should grip the heat source and heat source holder and the aerosol generating substrate of the aerosol generating article when the aerosol generating article is assembled. Preferably the outer wrapper circumscribes the aerosol generating substrate, at least a rear portion of the heat source and heat source holder and any other components of the aerosol generating article downstream of the aerosol generating substrate. Outer wrappers may be formed from any suitable material or combination of materials. Suitable materials are well known in the art and include, but are not limited to, cigarette paper. Alternatively or in addition, the mouthpiece may be circumscribed by tipping paper. Aerosol generating articles described herein may be assembled using known methods and machinery.

The aerosol generating article may be substantially cylindrical in shape. The aerosol generating or may be substantially elongate. The aerosol generating or has a length and a circumference substantially perpendicular to the length. The aerosol generating substrate may be substantially cylindrical in shape. The aerosol generating substrate may be substantially elongate. The aerosol generating substrate also has a length and a circumference substantially perpendicular to the length. The aerosol generating substrate may be located in the aerosol generating or such that the length of the aerosol generating substrate is substantially parallel to the airflow direction in the aerosol generating article. The transfer section or element may be substantially elongate.

The aerosol generating article may have any desired length. For example, the aerosol generating article may have a total length of between approximately 65 mm and approximately 100 mm. The aerosol generating article may have any desired external diameter. For example, the aerosol generating article may have an external diameter of between approximately 5 mm and approximately 12 mm.

One or more of the filter, transfer element, aerosol cooling element, and heat exchanger may be incorporated into a holder of the present invention rather than being included in the aerosol generating article. The length of the aerosol generating article may be reduced if one or more of the filter, transfer element, aerosol cooling element, and heat exchanger are incorporated into the holder. In some preferred embodiments, the holder comprises one or more of the filter, transfer element, aerosol cooling element, and heat exchanger, and the holder is re-usable.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Reference will now be made to the drawings, which depict one or more aspects described in this disclosure. However, it will be understood that other aspects not depicted in the drawing fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components.

The schematic drawings are not necessarily to scale and are presented for purposes of illustration and not limitation.

Figure 1:
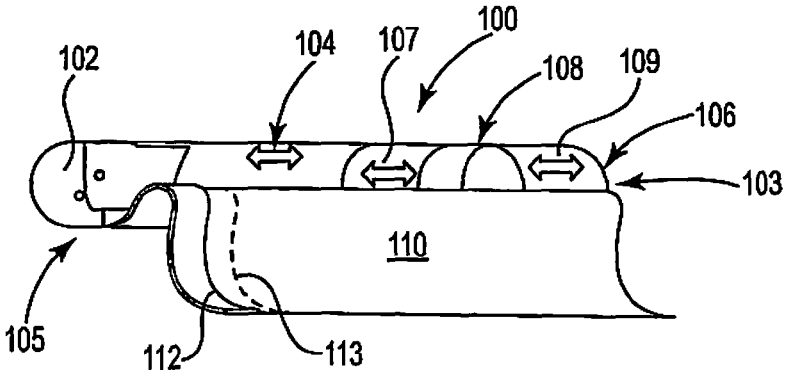
FIG. 1 is schematic perspective view of an illustrative aerosol generating article with the wrapper partially opened to view the internal contents.

Referring now to FIG. 1, an aerosol generating article 100 extends between a proximal end 103 and a distal end 105. The aerosol generating article 100 includes a combustible heat source 102 positioned at the distal end 105 of the aerosol generating article 100, an aerosol generating substrate 104 downstream of the combustible heat source 102 and a mouthpiece 106 downstream of the aerosol generating substrate 104 and positioned at the proximal end 103 of the aerosol generating article 100.

The aerosol generating article 100 comprises a combustible heat source 102, an aerosol generating substrate 104, an aerosol cooling element 107, an elongate expansion chamber or transfer element 108 and a mouthpiece 106, are in sequential, abutting coaxial alignment, which are overwrapped in an outer wrapper 110 of, for example, cigarette paper. The combustible heat source 102 is cylindrical.

The aerosol generating substrate 104 is located immediately downstream of the combustible heat source 102 and comprises a cylindrical plug of homogenized tobacco material comprising, for example, glycerin as aerosol former and circumscribed by filter plug wrap. A heat conducting element 112, consisting of a tube of aluminum foil, surrounds and is in contact with a rear portion of the combustible heat source 102 and an abutting front portion of the aerosol generating substrate 104. The elongate expansion chamber 108 is located downstream of the aerosol generating substrate 104 and comprises a cylindrical open-ended tube of cardboard. The mouthpiece 106 is located downstream of the expansion chamber 108 and comprises a cylindrical plug of cellulose acetate tow 109 circumscribed by filter plug wrap.

In use, the user ignites the combustible heat source which heats the aerosol generating substrate to produce an aerosol. When the user inhales on the mouthpiece 106 air is drawn through the aerosol generating substrate 104 through air inlet holes 113 in the cigarette paper 110 and adjacent to the aerosol generating substrate 104, through the expansion chamber 108, through the mouthpiece 106 and into the user's mouth.

Referring now to FIGS. 2A, 2B, 3A, 3B, 4A, 4B, 5A and 5B, a holder 200 includes a body 210, a sleeve 220, a mouthpiece 230, a tube 240, a first spring 250 and a second spring 260. The sleeve 220, which is slidably disposed over the body 210, comprises a ventilation region 222 and an extinguishment region 224 downstream of the ventilation region 222. The mouthpiece 230 is telescoping. Tube 240 is disposed in mouthpiece 230 and body 210. Spring 250 interacts with body 210 and sleeve 220 to bias sleeve towards an extinguishment position. Spring 260 interacts with body 210 and mouthpiece 230 to bias mouthpiece 230 to a use position.

Figure 2A:
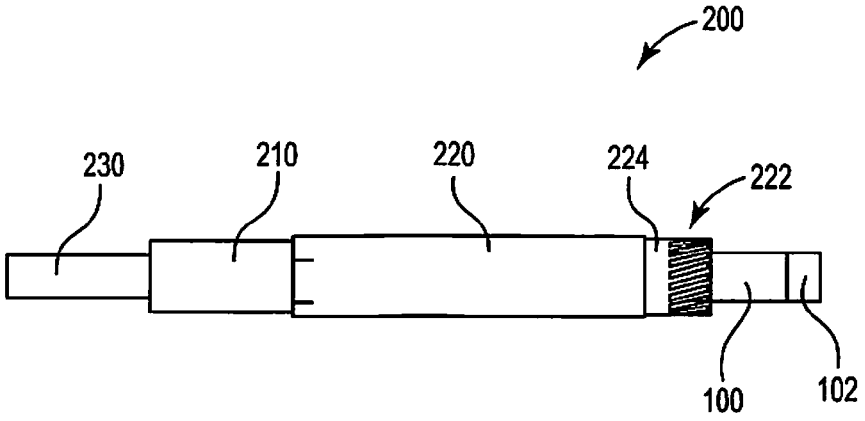
FIGS. 2A, 3A, 4A and 5A are schematic side views of an illustrative aerosol generating article in an illustrative holder.
Figure 2B:
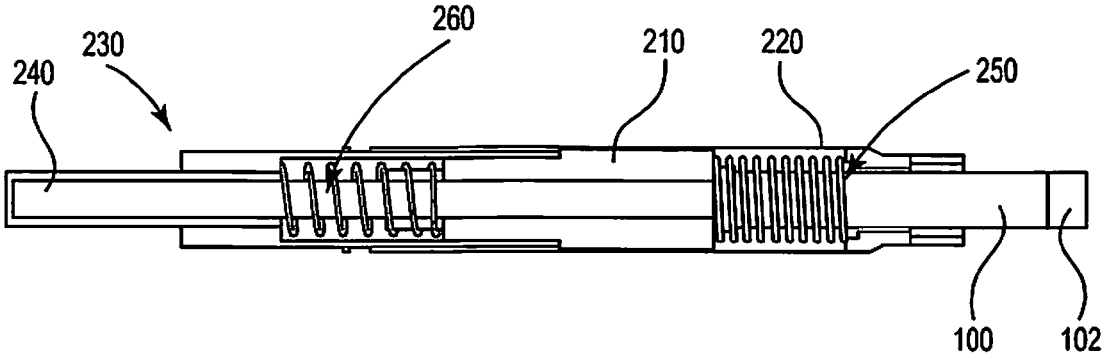
FIGS. 2B, 3B, 4B and 5B are schematic views of the aerosol generating article and holder illustrated in FIGS. 2A, 3A, 4A and 5A, respectively, with a portion of the holder cut-away.

In FIGS. 2A and 2B the holder 200 is in an insertion position in which an aerosol generating article 100 having a heat source 102 may be inserted into a passage of the body 210 of the holder 200. The sleeve 220 is retracted to allow insertion of aerosol generating article 100.

Figure 3A:
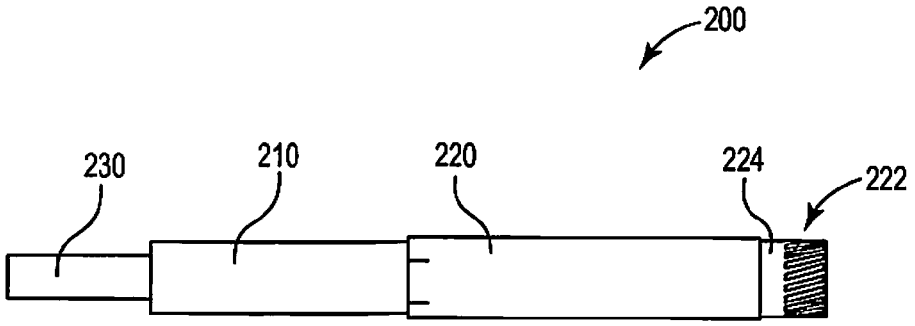
Figure 3B:
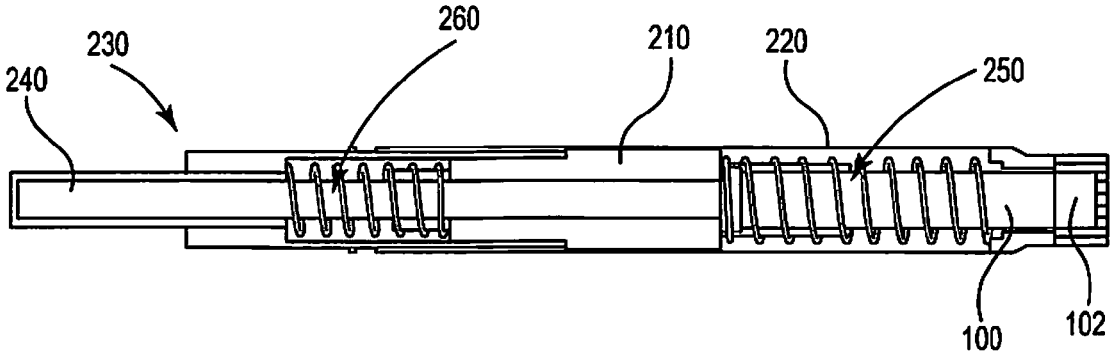

In FIGS. 3A and 3B the holder 200 is in a use position in which the heat source 102 of the aerosol generating article 100 is aligned with the ventilation region 222 of the sleeve 220. The ventilation region 222 surrounds the heat source 102 and provides sufficient air flow to the heat source to allow the heat source 102 to be ignited and to maintain combustion of the heat source 102.

Figure 4A:
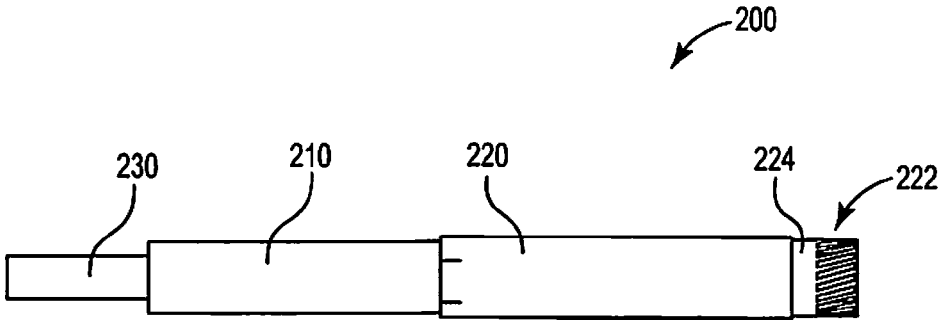
Figure 4B:
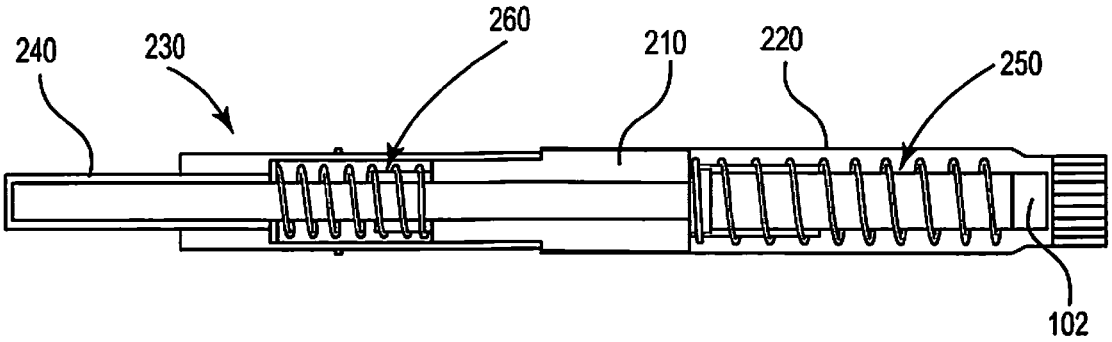

In FIGS. 4A and 4B the holder 200 is in an extinguishment position in which the heat source 102 of the aerosol generating article 100 is aligned with the extinguishment region 224 of the sleeve 220. The extinguishment region 224 surrounds the heat source 102 and restricts air flow to the heat source to extinguish the heat source 102.

Figure 5A:
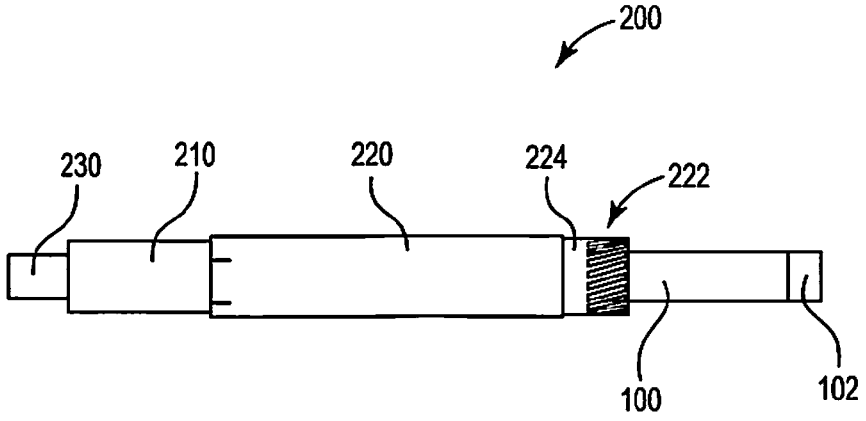
Figure 5B:
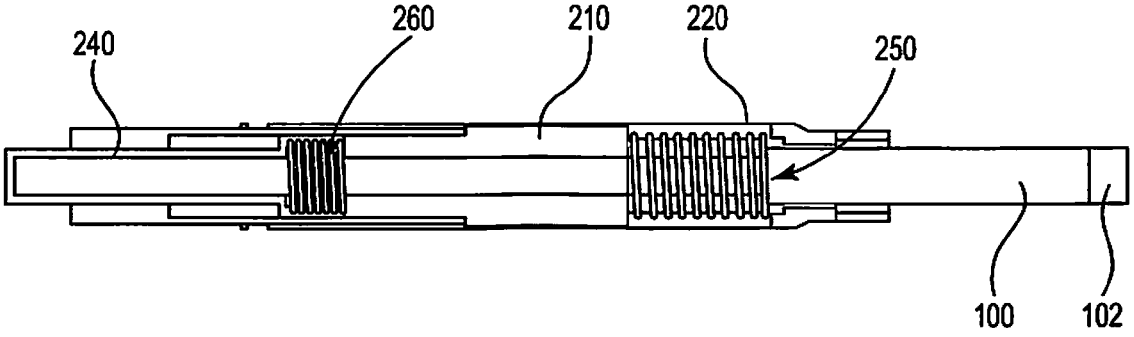

In FIGS. 5A and 5B the holder 200 is in an ejection position in which a mouth end of the mouthpiece 230 is distally collapsed, causing tube 240 to advance distally within the passage of the body 210 to eject the aerosol generating article 100 from the passage of the body 210. The sleeve 220 is also retracted, as a user may grasp the sleeve 220 while simultaneously pressing on the mouth end of the mouthpiece 230, which may cause the sleeve 220 to retract. Alternatively, the sleeve may be moved and locked into a retracted position prior to depressing the mouthpiece.

Figure 6:
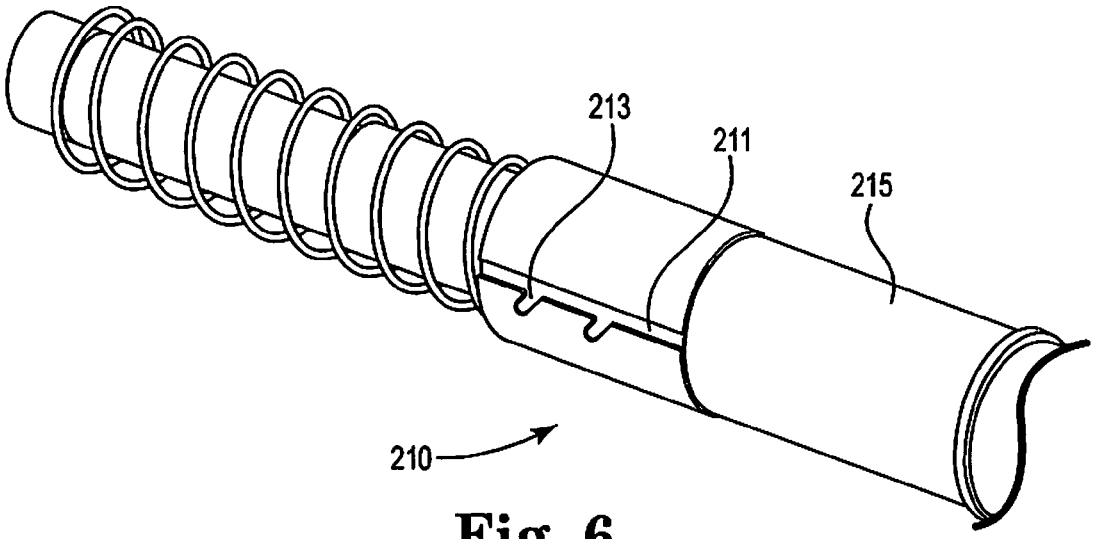
FIGS. 6 and 7 are schematic perspectives view of components of a portion of an illustrative holder.
Figure 7:
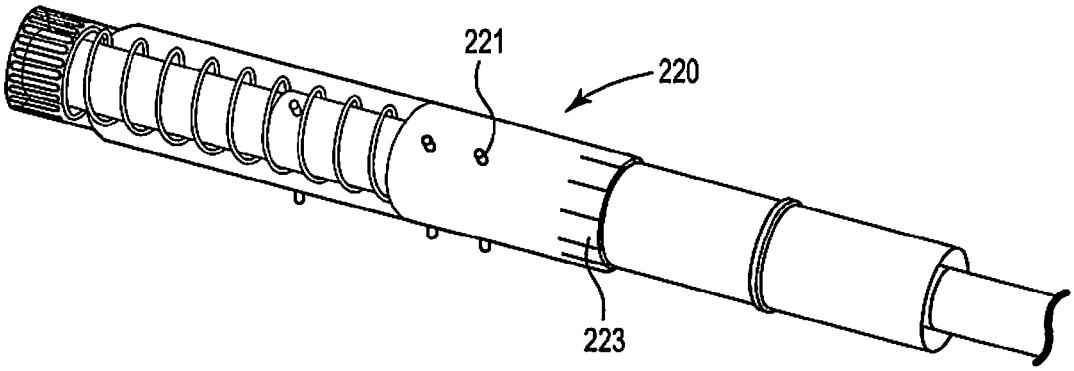

Referring now to FIGS. 6 and 7, an exterior surface of body 210 defines a longitudinal channel 211 and slots 213 extending away from, and continuous with the channel 211. The exterior surface of the body 210 also defines a longitudinal groove 215 for retaining the sleeve 220 about the body 210. The sleeve 220 comprises a detent 223 configured to be slidably received by the groove 216. The length of the groove 215 and thickness of the detent 223 of define the distance along which the sleeve 223 can be moved over the body 210. An inner surface of the sleeve 220 defines detent 221 which is slidably received in channel 221 of the body 210. When detent 221 is aligned with an intersection of channel 211 and slot 213, the sleeve 220 may be rotated about the longitudinal axis of the body 210 to lock detent 221 in slot 213.

Figure 8:
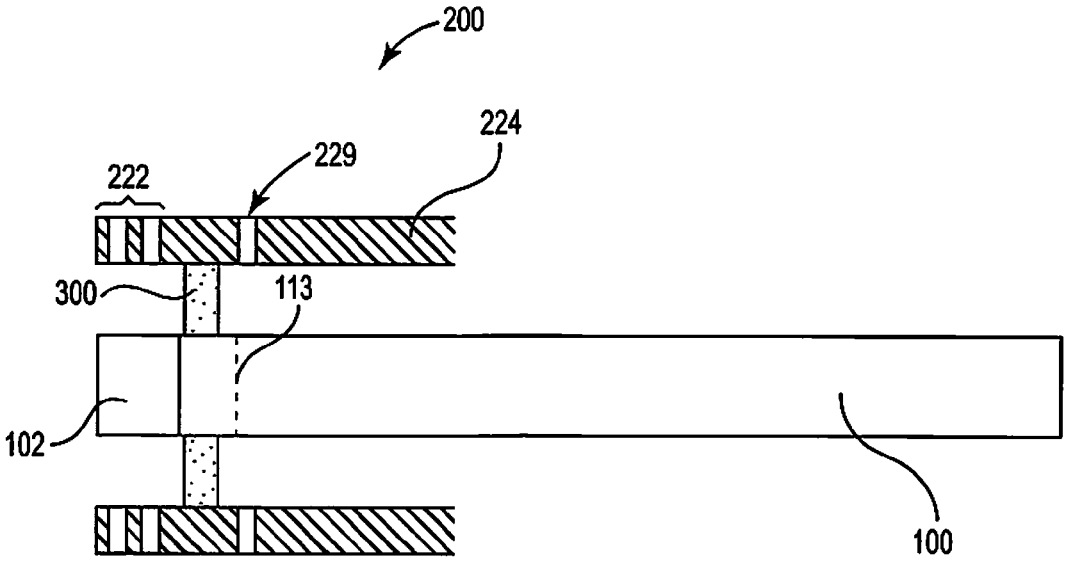
FIG. 8 is a schematic sectional view of an illustrative an illustrative aerosol generating article in a a portion of a body of an illustrative holder.

Referring now to FIG. 8, a holder may include a seal 300 that extends from an inner surface of sleeve 200, The seal 300 is arranged and configured to engage the aerosol generating article 100 downstream of the heat source 102. The sleeve 220 defines through holes 229 downstream of the seal 300. Air that flows through holes 229 may enter air inlets 113 of the of the aerosol generating article 100. The air may pass over the aerosol generating substrate in the article 100 to increase release of volatile compounds from the substrate, to increase delivery of volatile compounds to a user, or increase release of volatile compounds from the substrate and increase delivery of volatile compounds to a user. Seal 300 may limit or prevent combustion gasses from heat source 102 from entering air drawn through article 100. It will be understood that through holes 229 and seal 300 as depicted in FIG. 8 may be included in sleeves 200 as depicted in FIGS. 2-5 and 7.

Thus, methods, systems, apparatuses, assemblies and articles for a holder for aerosol generating articles are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts and aerosol generating article manufacturing or related fields are intended to be within the scope of the following claims.

The invention claimed is:

1. A holder for an aerosol generating article having a heat source, the holder comprising:

a body having a first end and a second end and passage extending from the first end to the second end, wherein the body is configured to receive the aerosol generating article into the passage; and a sleeve having a tubular body defining a first end and a second end, the tubular body comprising (i) a ventilation region comprising one or more holes through the tubular body in proximity to the second end, and (ii) an extinguishment region downstream of the ventilation region;

wherein the sleeve is movable over the body between (i) a retracted position, (ii) an extinguishment position, and (iii) a use position between the retracted position and the extinguishment position, wherein the second end of the sleeve is closer to the first end of the body when the sleeve is in the retracted position relative to when the sleeve is in the extinguishment position, wherein the ventilation region is configured to be aligned with the heat source of the aerosol generating article when the sleeve is in the use position, and wherein the extinguishment region is configured to be aligned with the heat source of the aerosol generating article when the sleeve is in the extinguishment position, and wherein the sleeve and body are configured to retain the sleeve in the use position when the sleeve is moved to the use position, wherein the sleeve and body are configured to retain the sleeve in the retracted position when the sleeve is moved to the retracted position, and wherein the sleeve and body are configured to retain the sleeve in the extinguishment position when the sleeve is moved to the extinguishment position.

2. The holder according to claim 1, wherein the passage of the body is configured to receive the aerosol generating article through the second end.

3. The holder according to claim 1, wherein the sleeve is biased towards the extinguishment position.

4. The holder according to claim 1, wherein the extinguishment region of the sleeve has an inner surface defining an inner diameter configured to provide a clearance of 0.2 mm or less between the heat source of the aerosol generating article and the inner surface of the sleeve at the extinguishment region when the extinguishment region is aligned with the heat source of the aerosol generating article.

5. The holder according to claim 1, wherein the sleeve is formed from a single part.

6. The holder according to claim 1, wherein the sleeve is formed from a material comprising one or more of polyether ether ketone (PEEK), polyoxymethylene (POM), and high density polyethylene (HDPE).

7. The holder according to claim 1, wherein the body, in proximity to the second end, is configured to engage and retain the aerosol generating article via an interference fit.

8. The holder according to claim 1, wherein the sleeve comprises an inner surface defining a detent, and wherein the body comprises an outer surface defining a longitudinal channel, wherein the channel is configured to receive the detent.

9. The holder according to claim 8, wherein the sleeve is at least partially rotatable about the body, and wherein the outer surface of the body further defines a slot extending away from, and contiguous with, the longitudinal channel, wherein the slot is configured to slidably receive the detent when the detent is aligned with an intersection of the slot with the channel and the sleeve is rotated.

10. The holder according to claim 9, wherein the sleeve is locked into the retracted position, the extinguishment position, or the use position when the detent is received by the slot.

11. The holder according to claim 1, further comprising a tube received in the passage of the body, wherein the tube has a first end and a second end, wherein the first end extends beyond the first end of the body, wherein the tube is slidable within the passage of the body between a use position and an ejection position, wherein the first end of the tube is further from the first end of the body when the tube is in the use position than when the tube is in the ejection position, and wherein sliding the tube in the passage of the body in a direction from the first end of the body to the second end of the body causes the aerosol generating article to be ejected from the passage of the body through the second end of the body.

12. The holder according to claim 11, wherein the tube is biased towards the retention position.

13. An assembly comprising holder according to claim 1 and the aerosol generating article having the heat source, wherein the aerosol generating article is received in the passage defined by the body of the holder.

14. A kit comprising a holder according to claim 1 and one or more aerosol generating articles having a heat source, wherein the aerosol generating articles are configured to be received by passage of the body of the holder.

15. The kit according to claim 14, wherein the aerosol generating article comprises an aerosol generating substrate and wherein the aerosol generating article is configured to transfer heat from the heat source to the aerosol generating substrate without combusting the substrate.

16. The kit according to claim 15, wherein the aerosol generating substrate comprises tobacco.

17. The assembly according to claim 13, wherein the aerosol generating article comprises an aerosol generating substrate and wherein the aerosol generating article is configured to transfer heat from the heat source to the aerosol generating substrate without combusting the substrate.

18. The assembly according to claim 17, wherein the aerosol generating substrate comprises tobacco.

19. The holder of claim 1, wherein sleeve and body interact to retain the sleeve and the body in the retracted position, the use position, and the extinguishment position via a retracted position slot, a use position slot, and an extinguishment position slot and one or more detents received in an appropriate slot.

20. The holder of claim 1, wherein sleeve and body interact to retain the sleeve and the body in the use position via a use position slot and a detent received in the use position slot.

* * * * *